United States Patent [19]

Thompson

[11] 4,348,717

[45] Sep. 7, 1982

[54] LUMINAIRE LOWERING DEVICE WITH CENTERING MEANS

[75] Inventor: Richard L. Thompson, Hendersonville, N.C.

[73] Assignee: General Electric Company, Schenectady, N.Y.

[21] Appl. No.: 818,368

[22] Filed: Jul. 25, 1977

[51] Int. Cl.[3] ..... F21V 21/36

[52] U.S. Cl. ..... 362/403; 362/391; 362/431

[58] Field of Search ..... 362/403, 391, 431

[56] References Cited

U.S. PATENT DOCUMENTS

| | | | |
|---|---|---|---|
| 3,633,980 | 1/1972 | Hunt | 308/6 R |
| 3,670,159 | 6/1972 | Millerbernd | 362/403 |
| 3,801,813 | 4/1974 | Kiehn | 362/403 |
| 3,805,054 | 4/1974 | Wolf | 362/403 |
| 3,847,333 | 11/1974 | Zeller | 362/403 |
| 3,958,116 | 5/1976 | Jones | 362/403 |
| 4,001,573 | 1/1977 | Derasp | 362/403 |
| 4,025,782 | 5/1977 | Kaeser | 362/403 |

*Primary Examiner*—Donald P. Walsh

*Attorney, Agent, or Firm*—Ernest W. Legree; Philip L. Schlamp; Fred Jacob

[57] ABSTRACT

Apparatus for maintaining coaxial alignment of luminaire support ring on a pole as it is raised or lowered on the pole. The aligning apparatus comprises a plurality of roller members secured around the support ring and resiliently urged against the pole surface to maintain the support ring in substantially centered position relative to the pole and to avoid shock to the luminaires by impact of the support ring on the pole.

10 Claims, 6 Drawing Figures

6a
8
6
6b
2
3
3
3
1
15
6a
5
6
8
6b
4
9
4
4
7
3
9
7
1
3
2
10
12
11
13
12b
13

LUMINAIRE LOWERING DEVICE WITH CENTERING MEANS

The present invention relates to luminaire supports and more particularly concerns apparatus for raising and lowering a ring-like luminaire support on a pole while maintaining alignment of the luminaire support relative to the pole.

It is an object of the present invention to provide an improved apparatus of the above type to maintain the ring-like luminaire support substantially coaxial with the pole on which it is mounted as the support is raised and lowered on the pole.

Another object of the invention is to provide apparatus of the above type which accommodates to poles of different diameter and to portions of the same pole of different diameter.

It is a further object of the invention to provide apparatus of the above type which avoids contact of the support ring with the pole and thereby prevents shock to the luminaires by such impact.

Still another object of the invention is to provide apparatus of the above type which is simple in construction, readily assembled and reliable in operation.

Other objects and advantages will become apparent from the following description and the appended claims.

With the above objects in view, the present invention relates to a centering apparatus for maintaining a ring-like luminaire support substantially coaxial with a pole on which the support is adopted to be mounted comprising, in combination, a ring-like support member, a plurality of generally U-shaped guide members each having opposite arms securing the guide members at circumferentially spaced locations on the support member for movement of the guide members toward and away from the axis of the support member, resilient means on the arm members constantly urging the respective guide members toward the axis of the support member for yieldably engaging the proximate surface of the pole, whereby when the ring-like support member is mounted encircling the pole and moved up and down therealong, the support member is automatically maintained in substantial coaxial alignment with the pole.

The invention will be better understood from the following description taken in conjunction with the accompanying drawings, in which.

Figures 1, 2:
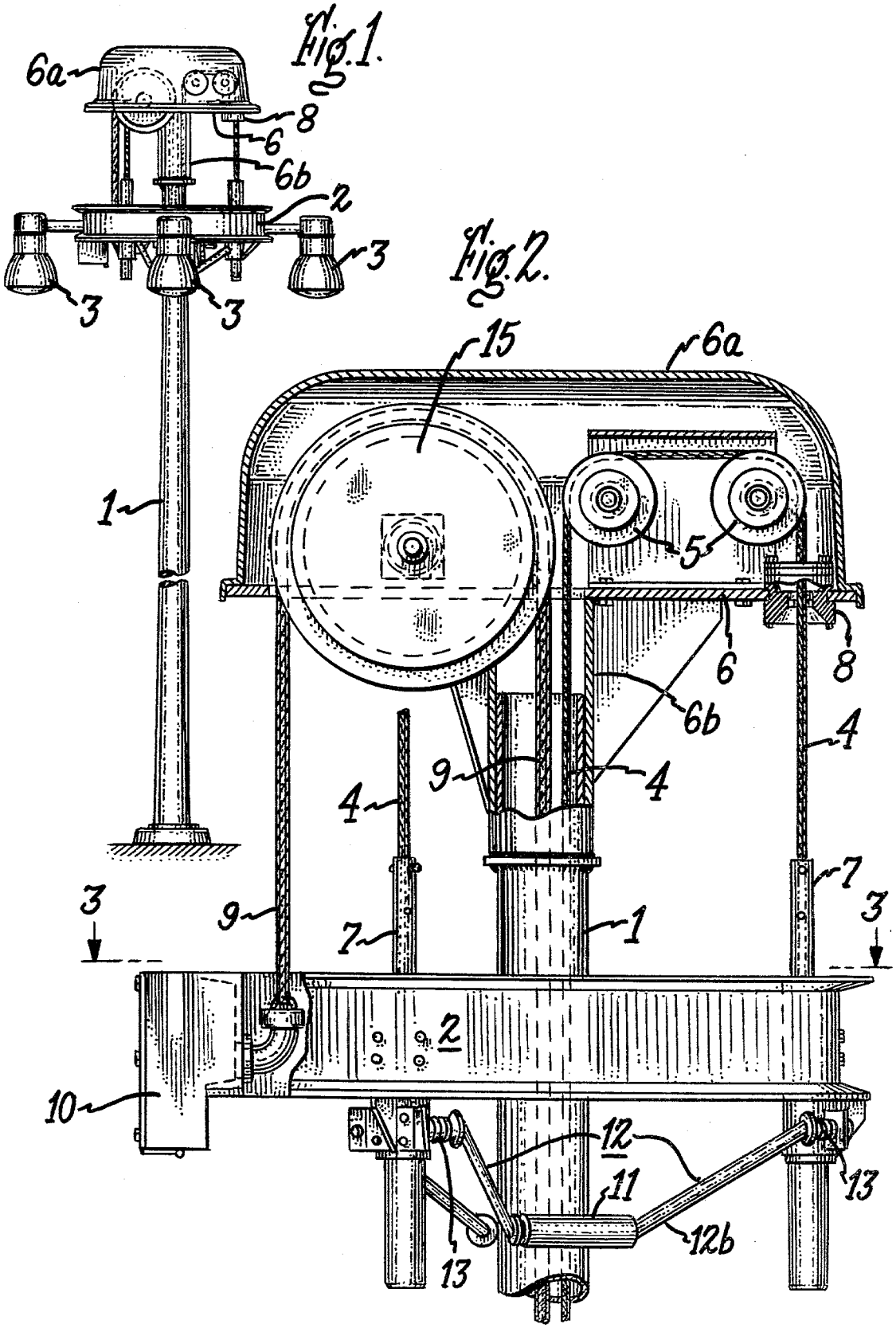
FIG. 1 is a view in elevation of an annular luminaire support mounted on a pole with means for raising and lowering the support, and having a centering apparatus in accordance with the invention.
FIG. 2 is a view of the upper portion of the pole showing in elevation the annular luminaire support and centering apparatus associated therewith.

Referring now to the drawings, and particularly to FIG. 1, there is shown light pole 1 of high-mast type which is of tubular shape tapering somewhat toward its upper end. Mounted on the top of pole 1 is head plate 6 with associated cover 6*a* and sleeve (slip-fitter) 6*b* which fits over the top portion of the pole. Surrounding pole 1 is luminaire support ring 2 having secured thereto a number of luminaires 3 uniformly spaced around the support ring. A plurality of hoisting cables 4 (typically three) secured to support ring 2 pass over correspondingly arranged pairs of sheaves 5 (see FIG. 2) mounted on head plate 6 and extend downwardly through the interior of the pole to suitable motorized winch apparatus at the bottom of the pole (not shown), which is operable for raising and lowering luminaire support ring 2 by winding and unwinding cables 4. Support ring 2 is held in its uppermost (operative) position by a plurality of latches 7 mounted on ring 2 to which the hoist cables 4 are respectively attached and which engage latch locking devices 8 correspondingly arranged on head plate 6. The latching apparatus and its operation are more fully disclosed in related co-pending application Ser. No. 826,497 filed Aug. 22, 1977 and assigned to the same assignee as the present invention.

Power cable 9, connected at one end to wiring box 10 secured to support ring 2 for transmitting current to luminaires 3, passes around power cable sheave 15 and downward through pole 1 for connection to a power source (not shown) near the bottom of the pole.

Figure 3:
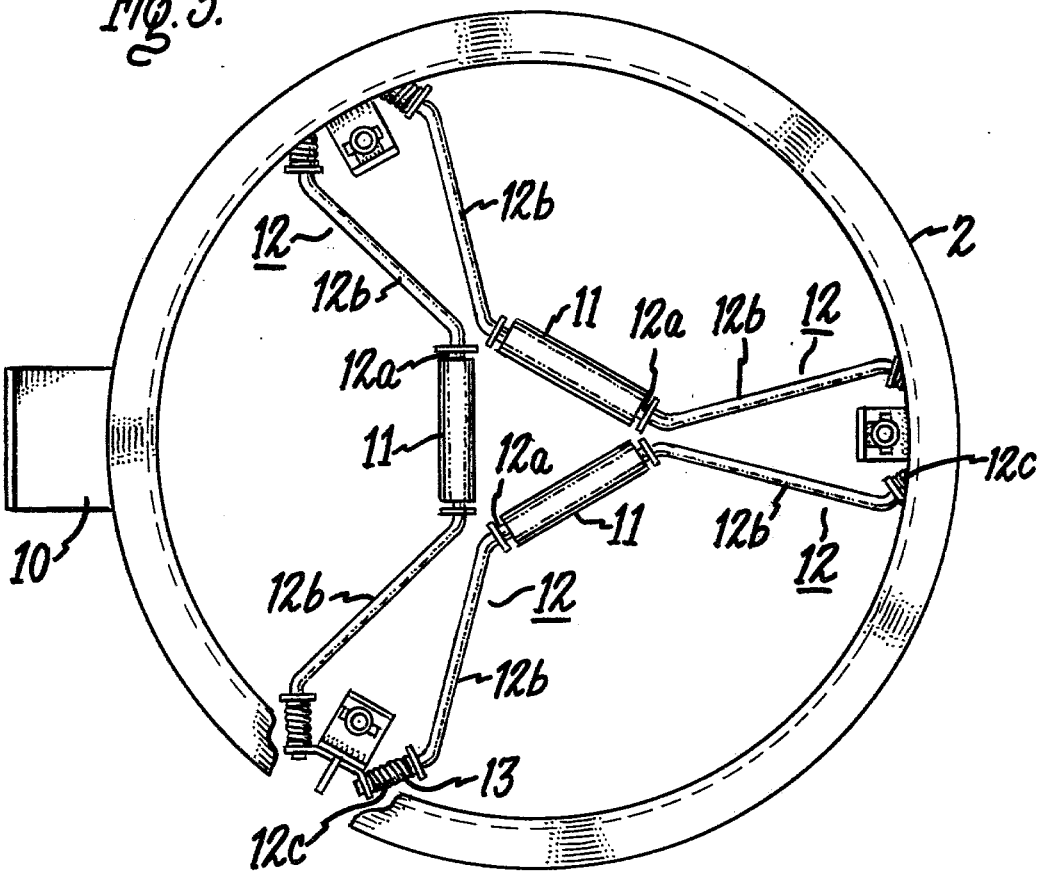
FIG. 3 is a plan view of the centering apparatus taken along the line 3—3 of FIG. 2.

In accordance with the present invention, apparatus is provided for maintaining support ring 2 centered on the pole, especially during its movement between its upper (operative) position and its lower (service) position, so as to avoid undesirable interference of support ring 2 and associated parts with pole 1, such as may be caused by winds, warping of the pole, or other conditions. The centering apparatus in the illustrated embodiment, as seen in FIGS. 2 and 3, comprises three generally U-shaped guide members 12 each formed with a central portion 12*a* on which elongated roller 11 is rotatably mounted. Arms 12*b* of member 12 extend in divergent directions from the central portion and have opposite end portions or shafts 12*c* extending outwardly at an angle thereto so as to define an axis parallel to the axis of central portion 12*a* about which roller 11 rotates. Arm end portions 12*c* are pivotally secured to support ring 2 by suitable brackets or the like for pivoting about their above-mentioned axis, and coil springs 13 are arranged thereon so as to constantly urge rollers 11 toward the axis of support ring 2 and into contact with the adjacent (proximate) surface of pole 1. As will be seen, the dimensions of guide members 12 are such that the maximum radial extension thereof toward the axis of support ring 2 is less than the radius of the support ring. Under usual conditions, the axis of roller 11 is lower than the pivot axis of the outer ends of guide member 12. As support ring 2 is lowered on pole 1, guide members 12 pivot downwardly and rollers 11 move farther away from the plane of support ring 2 as the diameter of the pole increases. Since each guide member 12 pivots about a chord of a circle whose center is at the axis of support ring 2, roller 11 is always held tangent to the pole in a position substantially perpendicular to a radius of support ring 2 which substantially bisects roller 11. By virtue of the spring-biased roller arrangement shown, rollers 11 maintain a force tending to restore support ring 2 to a centered position substantially coaxial with the pole and serve as a shock absorbing means to avoid shock to the luminaires mounted on ring 2.

Figure 5:
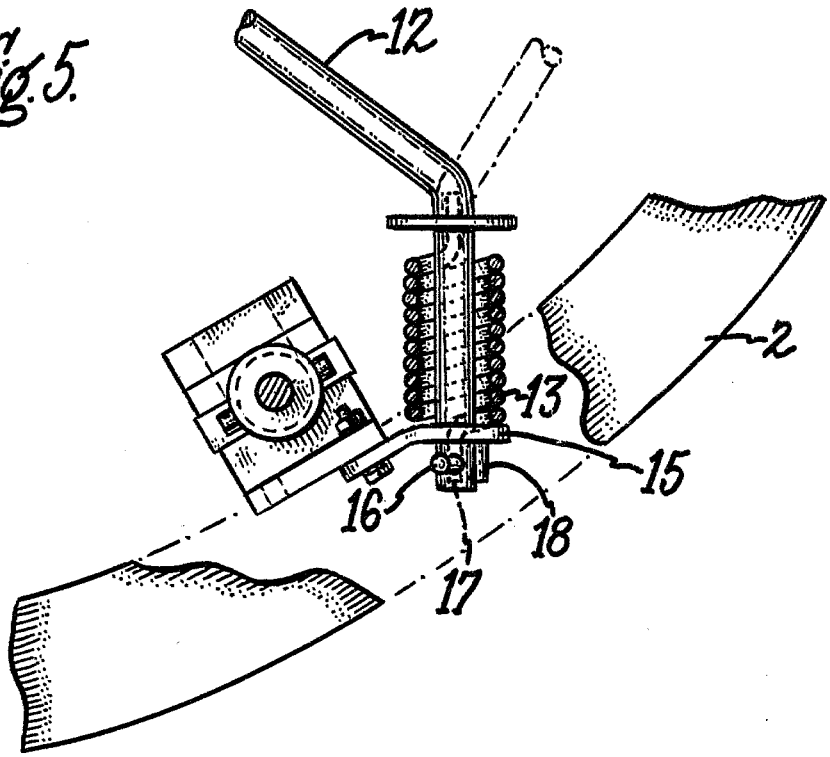
FIG. 5 is a plan view of a portion of the apparatus shown in FIG. 3 showing a modification thereof.
Figure 6:
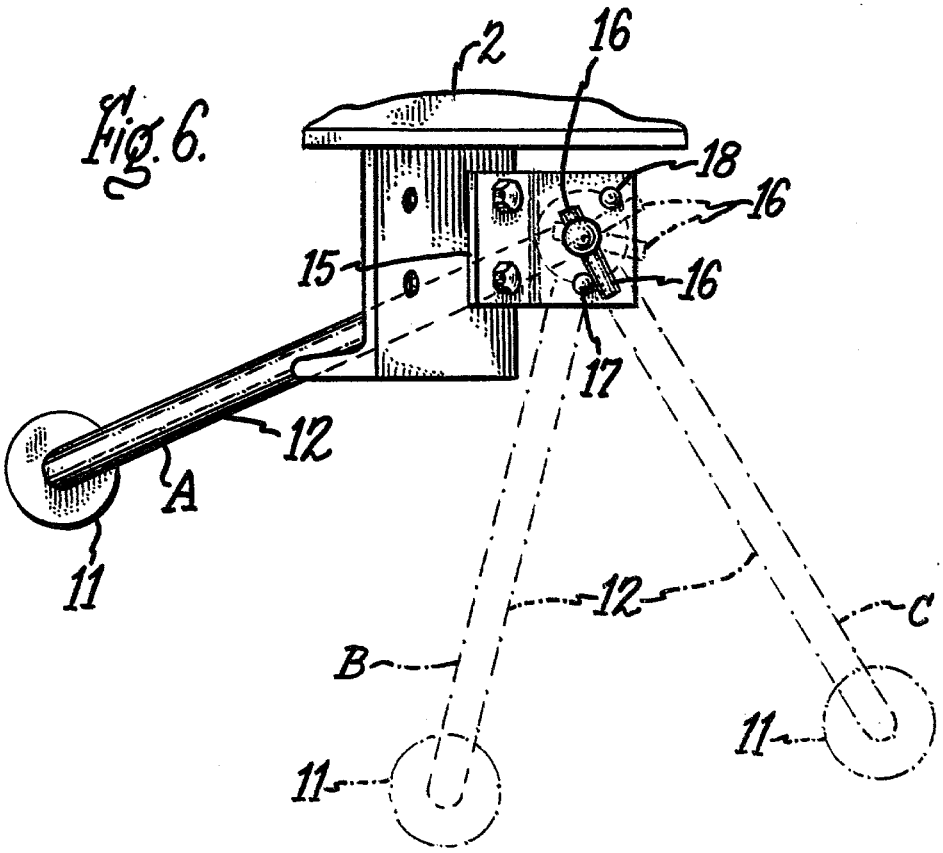
FIG. 6 is a view in elevation of the modification shown in FIG. 5.

In a preferred embodiment of the invention, means are provided for limiting the extremes of movement of guide members 12. As seen in FIGS. 5 and 6, shafts 12*c* at the opposite ends of guide members 12, which pivot in support brackets 15, are provided with pins 16 projecting through the shaft normal to its axis, as seen best in FIG. 6. Stops 17 and 18, one of which may be constituted by the projecting end of coil spring 13, are provided on bracket 15 which are engageable by pin 16 to limit the range of pivotal movement of guide members 12. Shown in FIG. 6 are three different positions A, B and C of guide member 12. When support ring 2 is forced off-center by winds, for example, so as to cause one roller 11 to move downwardly against the pole, the remaining rollers 11 are kept from riding upwardly on the pole to a level as high as the horizontal plane containing the pivot axis of the support ring 2, as illustrated by position A of guide member 12 in FIG. 6, wherein pin 16 strikes stop 17 to prevent further inward pivoting of guide member 12. In this way, rollers 11 are maintained in the proper position not only for keeping the support ring centered on the pole, but also for facilitating installation of the support ring on the pole.

The extreme outward movement of guide member 12 is limited to position C wherein pin 16 strikes stop 18. In this way, the movement of support ring 2 toward the pole is limited to a position wherein the guide member does not extend beyond the circumference of support ring 2, so as to always space ring 2 from the pole and thereby avoid marring or damaging the pole surface by contact with the support ring, especially during the raising or lower procedure, and also to prevent shock to the luminaires and their components by such contact.

Position B of guide member 12 represents an intermediate position between the inward and outward extremes of pivotal movement of guide member 12, with pin 16 free to move between stops 17 and 18.

Figure 4:
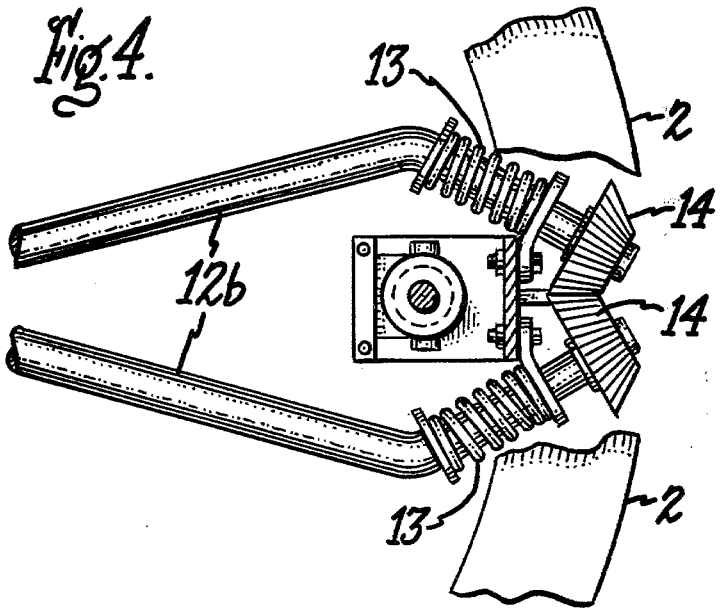
FIG. 4 is a plan view of a portion of the centering apparatus showing a modification of the apparatus shown in FIG. 3.

FIG. 4 illustrates a modification of the above-described device, wherein guide members 12 are interconnected at their outer ends by gears 14 so that the guide members are forced to act in concert. Thus, when support ring 2 moves off-center causing one roller 11 to move downwardly away from support ring 2 in contact with pole 1, the other two rollers 11 similarly move downwardly but will not be in contact with the pole. The advantage of this arrangement is that the other two rollers will not exert any force on the pole which must be overcome by the one roller in re-centering the support ring. Also, since the rollers always move in the same direction to the same degree, any problems which might result from the rollers moving in opposite directions relative to the support ring are avoided.

As will be understood, other means of interconnecting members 12 may be employed if desired.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

I claim:

1. Centering apparatus for maintaining a ring-like luminaire support substantially coaxial with a pole on which the support is adapted to be mounted comprising, in combination, a ring-like support member, a plurality of generally U-shaped guide members each having opposite arms securing said guide members at circumferentially spaced locations on said support member for movement of said guide members toward and away from the axis of said support member, the maximum radial extent of said guide members toward the axis of said support member being less than the radius of said support member, resilient means on said guide members constantly urging the respective guide members toward the axis of said support member for yieldably engaging the proximate surface of the pole, each of said generally U-shaped guide members being respectively entirely on one side of the pole when said support member is mounted encircling the pole, whereby when said ring-like support member is mounted encircling the pole and moved up and down therealong, said support member is automatically maintained in substantial coaxial alignment with the pole.

2. Apparatus as defined in claim 1, said guide members each having an elongated roller rotatably mounted thereon between said opposite arms for rollably engaging the surface of the pole.

3. Apparatus as defined in claim 2, each guide member being turnable about a pivot axis forming a chord of said ring-like support member, said roller being mounted for rotation about an axis substantially parallel to said pivot axis.

4. Apparatus as defined in claim 3, each said roller being arranged permanently substantially perpendicular to a radius of said ring-like support substantially bisecting the roller.

5. Apparatus as defined in claim 1, and means for limiting movement of said guide members toward and away from the axis of said support member.

6. Apparatus as defined in claim 5, bracket means mounting said guide members on said support member, said arms of said guide members being pivotally mounted in said bracket means, said movement limiting means comprising co-acting stop means on said bracket means and said arms of said guide members.

7. Apparatus as defined in claim 6, said co-acting stop means being arranged so that the movement of said guide members toward said axis is limited to a position wherein said guide members are below the plane of said support member, and the movement of said guide members away from said axis is limited to a position wherein said guide members do not extend beyond the circumference of said support member.

8. Apparatus as defined in claim 1, and means interconnecting said guide members for movement of said guide members in unison.

9. Apparatus as defined in claim 8, said interconnecting means comprising gear means on said arms of said guide members.

10. Apparatus as defined in claim 1, wherein said plurality of guide members comprise three guide members substantially uniformly circumferentially spaced on said support member.

* * * * *